US006892659B2

(12) United States Patent
Petretto

(10) Patent No.: US 6,892,659 B2
(45) Date of Patent: May 17, 2005

(54) MULTI-SECTION BOAT SAIL

(76) Inventor: Gesuino Petretto, Viale Adriatico, 147, 00141 Rome (IT)

( * ) Notice: Subject to any disclaimer, the term of this patent is extended or adjusted under 35 U.S.C. 154(b) by 0 days.

(21) Appl. No.: 10/487,311

(22) PCT Filed: Sep. 13, 2002

(86) PCT No.: PCT/IT02/00584

§ 371 (c)(1),
(2), (4) Date: Feb. 20, 2004

(87) PCT Pub. No.: WO03/024782

PCT Pub. Date: Mar. 27, 2003

(65) Prior Publication Data

US 2004/0206286 A1 Oct. 21, 2004

(30) Foreign Application Priority Data

Sep. 21, 2001 (IT) ..... RM2001A0573

(51) Int. Cl.[7] ..... B63H 9/04
(52) U.S. Cl. ..... 114/102.22
(58) Field of Search ..... 114/102.1, 102.22, 114/102.23

(56) References Cited

U.S. PATENT DOCUMENTS 5,775,249 A 7/1998 Samuel
5,931,109 A 8/1999 Hill
2002/0100406 A1 * 8/2002 Costa et al. ..... 114/102.22

FOREIGN PATENT DOCUMENTS

FR 2 645 112 10/1990
FR 2 748 982 11/1997

* cited by examiner

*Primary Examiner*—Stephen Avila
(74) *Attorney, Agent, or Firm*—Hedmen & Costigan, P.C.

(57) ABSTRACT

The invention relates to a boat sail comprising a first (4) and a second (6) sheet, having similar shape and dimensions, coupled each other in correspondence of the outer perimeter and by a plurality of transverse ribs (12), provided between said sheets (4, 6), suitable to divide said sail into multi-sections (11), said sail (2) being characterised in that it provides a valve (14), that can be opened and closed to allow the air to enter within said sail into the space between said first (4) and second (6) sheets, at least a retractor element (15) provided on each rib (12), that can take two positions, respectively for the closure of the rib (12) and for opening the same, in order to make the sail taking a wing contour shape, and means (16) for opening and closing said retractors.

15 Claims, 5 Drawing Sheets

MULTI-SECTION BOAT SAIL

The present invention concerns a boat sail.

More specifically, the invention refers to a three-dimensional boat sail. Even more particularly according to the invention the solution results to be more advantageous for high performance boats, for example catamarans and windsurfs.

As it is well known, a rigid sail considerably improves the performances of a boat, especially concerning the speed.

A problem of the sailing boats, especially of the ones with high performance, is the difficulty of reconciling the advantages of using a rigid sail with the disadvantages of the high costs, the bulk, since they can be not folded up, and the high weight.

Particularly, in the case of windsurfs, it would be practically impossible to carry a rigid sail on the car roof, as usually happens with the traditional sails, that can be folded up or winded round the mast.

Rigid sails, realised in aluminium so that to have a reduced weight, are nowadays used on particular kinds of racing boats, for example catamarans, but their use is limited to the competitions. The applied technology, in fact, especially for the high costs and bulk, has never used for current boats.

The object of the present invention is to provide for a three-dimensional sail, easily lowered and hoisted, and therefore folded up, of reduced weight and dimensions, but at the same time with high performance.

The GB 1.222.899 describes a sail provided for a sheet of flexible material, coupling to a support so that to receive the wind impact, a inflatable space, integral to said sheet, said space having opposite sides of flexible material to define an external outline, and exposed opening means, integral to said space, placed so that to receive air during the normal use of the sail.

The GB 2.295.998 patent describes a sail with an internal membrane and two external ones, fixed both round the outline of a side respect to the sail, with a respective pocket. The width of the space of the internal membrane is inferior to the one of the external membrane of the sail, so that to, during the use, the sail has an aerodynamic transversal section. An inflatable separated space is provided for next to the fore outline of the sail.

The known previous solutions are characterised by some disadvantages that have avoided the practical development.

Firstly, according to the prior art, the sails, if felt overboard, fill with water, compromising the floatation of the sail and the boat both.

Moreover, said sails do not have a variable outline respect to the tack (provenience direction of the wind respect to the boat), on which the boat is proceeding, so that there is not an optimum utilisation of the features of the sail in sections.

Considering the above, it is specific aim of the present invention to supply a sail with features able to overcome the mentioned disadvantages.

The main object of the invention is to supply a sail with variable wing outline, auto-inflatable and unsinkable.

The three-dimensional sail, realised according to the invention, can be applied on every kind of sail boat (sporting, windsurf, catamaran) and, considering its structural features and lightness, can be easily fold up and transported.

Moreover, the three-dimensional sail can rapidly turn into a traditional sail.

The above mentioned and other objects of the invention result to be clearer with the description of its preferred embodiments with reference to the enclosed figures, in which.

In the description of the different embodiments, to indicate the same elements, will be used the same numerical references.

Figure 1:
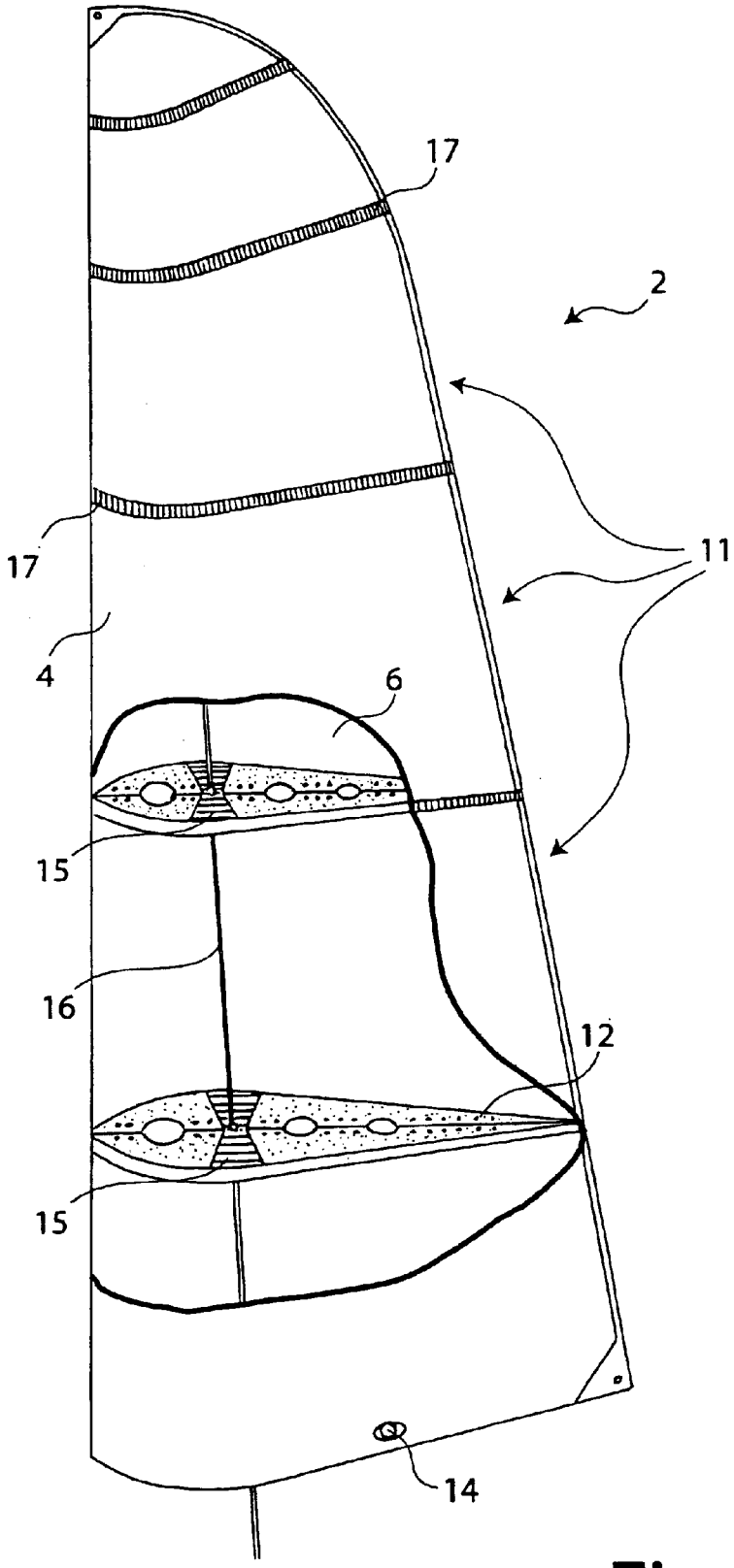
FIG. 1 is a perspective view of a first embodiment of the sail for boats realised according to the present invention.
Figure 2:
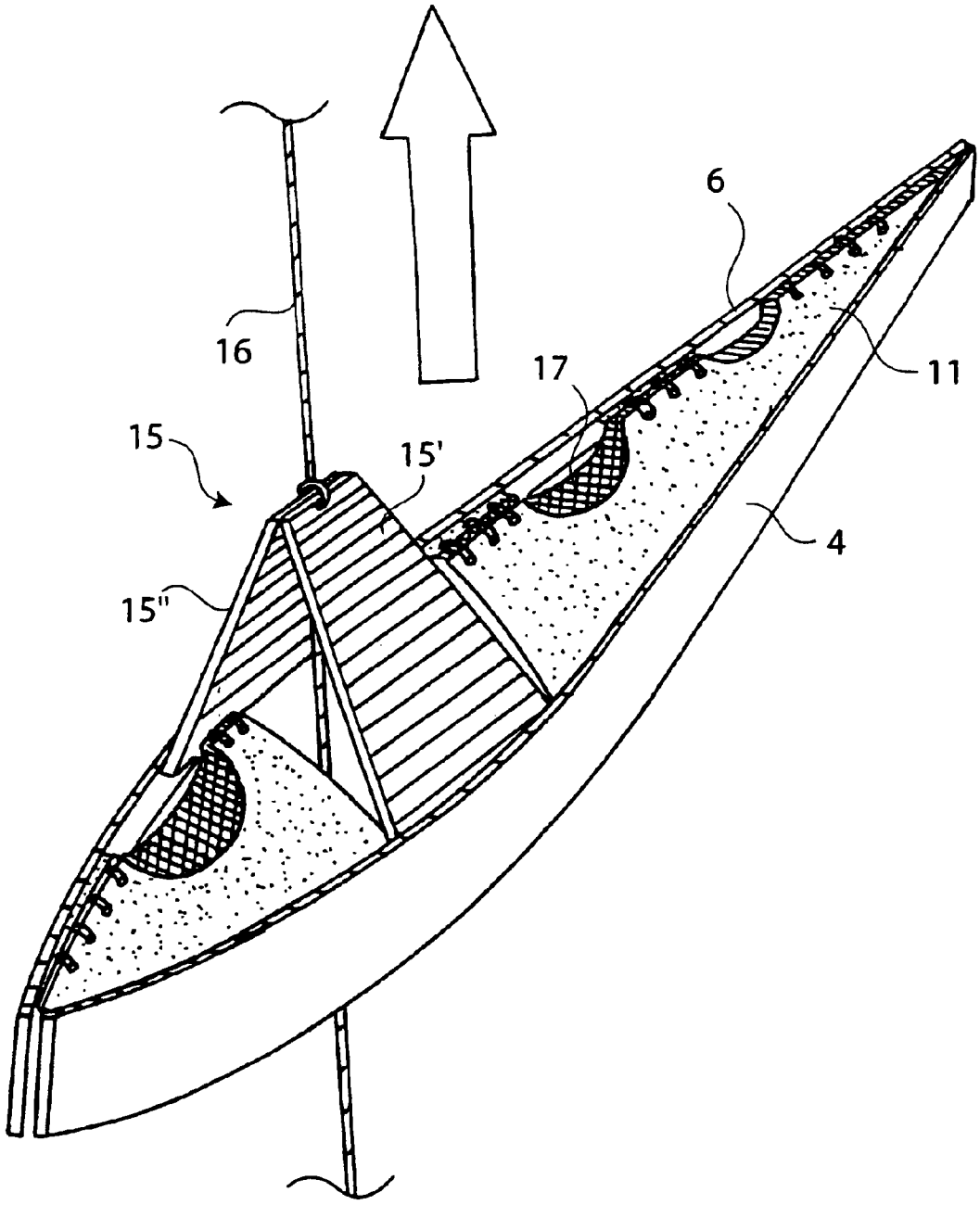
FIG. 2 is a first view of a particular of the sail of FIG. 1.
Figure 3:
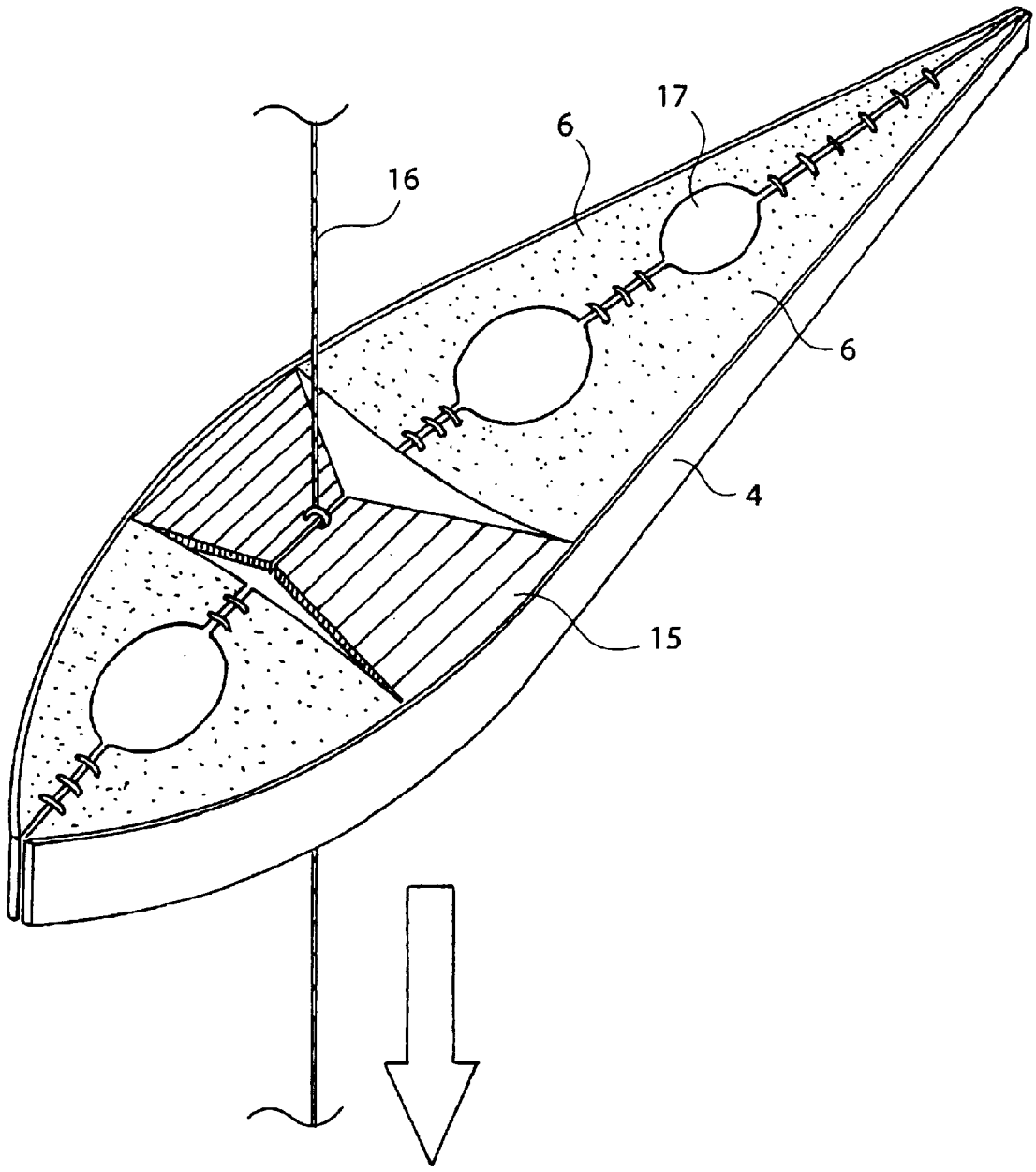
FIG. 3 is a second view of a particular of the sail of FIG. 1.

With reference to FIG. 1 to 3, it is shown a sail 2 for triangular boat, realised according to an embodiment of the present invention, comprising a first 4 and a second 6 sheet, with the same shape and dimension, coupled with a seam on the external outline. Two 4 and 6 sheets are joined with several transversal textile ribs 12, that divide the sail 21 in horizontal sections 11.

Two sheets 4 and 6 and the transversal ribs 12 are realised with synthetic material of nautical kind and joined with ribs.

The sail 2 is supported in a traditional way by a mast and by a boom (not shown).

In the inferior part of the sail is provided for a valve 14, that allows the entry and exit of air internal to the sail 2, between the sheet 4 and 6.

Corresponding with the ribs 12 are provided for retractors 15, vertically joined by a cable 16, that during the sail hoisting 2, allow to stretch the ribs 12, so that to obtain a wind outline.

Said retractors 15 can be horizontal and vertical and it is also possible to provide for a great number of retractors 15 for any rib.

In FIG. 1 are even shown the sticks 17, that can be realised in any suitable material, as for example fibreglass, carbon, etc.

The valve 14 allows the entry of the air between the sheets 4 and 6 of the sail 2, during the hoisting, so that the sail 2, according to the invention, results self-inflatable.

When inflated, the valve 14 is closed, so that, in case of falling overboard of the sail, it results unsinkable.

The valve 14 can be provided for on the sail 2 in any convenient position.

The ribs 12 are provided for holes 28 for the air passing in the different section of the sail 2.

From the FIGS. 2 and 3 it is possible to better observe the structure of the retractor 15 and its action of giving a wind outline to the sail 2 according to the invention.

The retractor 15 is made of two parts 15' and 15", laterally joined to the sheets 4 and 6, and centrally coupled so that to being moved closer or away, as a bridge or a folding. The closing and the opening of the hemi-parts 15' and 15" of the retractor is obtained with a cable 16 that, if forced according to arrow A of FIG. 2 determines the closing of the hemi-parts 15' and 15", closing the sail, and if forced according to arrow B of FIG. 3 determines the opening of the hemi-parts 15' and 15", giving to the sail the wind outline.

Figure 4:
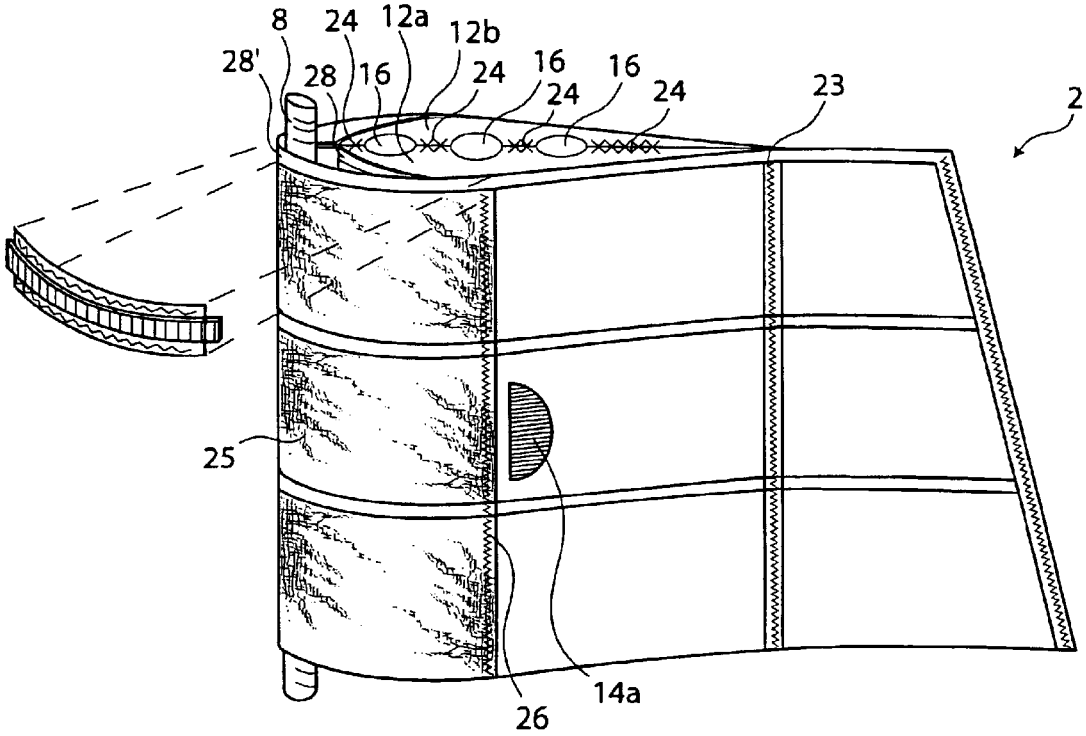
FIG. 4 is a partial lateral view of an embodiment of the sail for boat realised according to the present invention.
Figure 5:
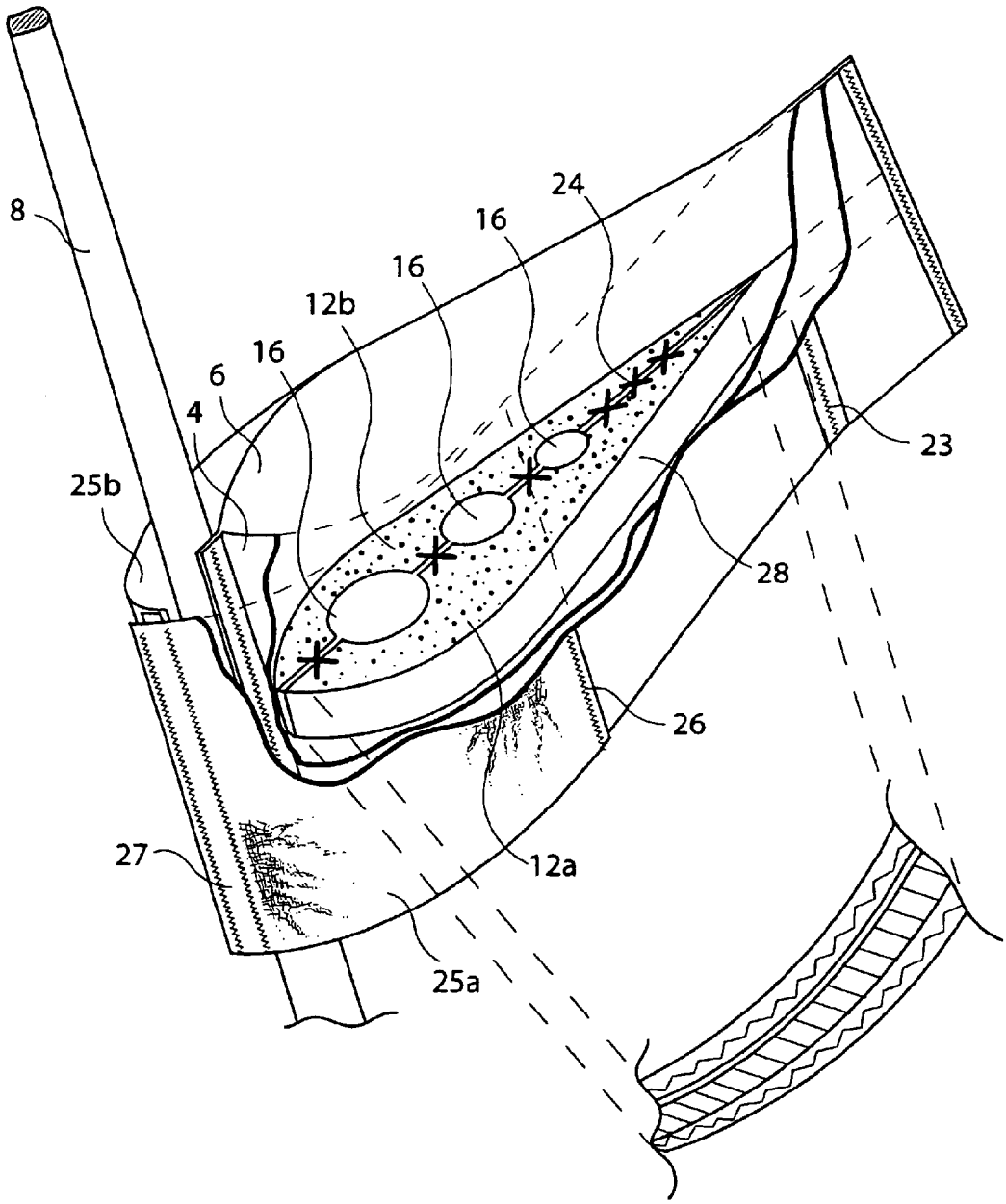
FIG. 5 is a perspective partial view of the sail of FIG. 4.

With reference to the FIG. 4 and 5, it is shown a second embodiment of the sail according to the invention.

Particularly, with respect to the sail of FIGS. 1 and 2, the first 4 and the second 6 sheets are coupled each other, by a sewing line 23, in such a way that a portion of the sail 2, from the sewing line 23 to the outer perimeter of the same sail, from the balumina side, is flat.

Still more particularly, from the sewing line 23 up to the balumina side, it can be provided only one of the two sheets 4 or 6.

Furthermore, to better help the inflating and deflating motion of the sail, transverse ribs 12 are realised by a first 12*a* and a second 12*b* part, said parts being symmetrical and coupled each other by sewings 24, or other coupling system, along a median line, realising a folding line.

Sail 2 is not directly coupled to the mast 8, but provides a mast pocket 25, coupled to the first 4 and to the second 6 sheet by sewings 26. Said pocket can also be comprised by two edges 25*a* and 25*b*, coupled by a Velcro® strip, or by other coupling means. Said mast pocket 25 confers to the sail a still more lifting profile, able to conform to the particular wind conditions due to the different paces, conferring to the same sail a further advantage with respect to the traditional sails.

Sail 2 and the mast pocket 25 are respectively provided with pockets 28, 28', for the insertion of the stiffening slats.

Said pockets 28 of the sail allow the insertion of the slats from the balumina side, in case the mast pocket 25 is realised by two coupable edges 25*a*, 25*b*.

This second solution allows to realise a balumina side without slat tensioning means, that otherwise would worsen the aerodynamic profile of the sail.

Sail 2 can be realised with each shape and model, and thus can be used for each kind of sailing boat, catamaran or windsurf.

The present invention has been described for illustrative but not limitative purposes, according to its preferred embodiments, but it is to be understood that modifications and/or changes can be introduced by those skilled in the art without departing from the relevant scope as defined in the enclosed claims.

What is claimed is:

1. Boat sail comprising a first (4) and a second (6) sheet, having similar shape and dimensions, coupled each other in correspondence of the outer perimeter and by a plurality of transverse ribs (12), provided between said sheets (4, 6), suitable to divide said sail into multi-sections (11), said sail (2) having:

a valve (14), that can be opened and closed to allow the air to enter within said sail into the space between said first (4) and second (6) sheets, at least a retractor element (15) provided on each rib (12), that can take two positions, respectively for the closure of the rib (12 and for opening the same, in order to make the sail taking a wing contour shape, and means (16) for opening and closing said retractors said at least one retractor (15) is comprised of two hemi-parts (15', 15"), comprised of rigid material, having one end coupled to one of said sheets (4, 6), and the other end centrally coupled to the corresponding end of the other hemi-part, said central ends being hinged in such a way to open and close the retractor (15), said retractor opening and closure means (16) acting on said central ends of the hemi-parts (15', 15") of the retractor (15).

2. Sail (2) according to claim 1, wherein said valve (14) is provided in the lower portion of the sail (2).

3. Sail (2) claim 1, wherein said sail is provided more than one retractor (15) for each rib (12).

4. Sail (2) claim 1, characterised in that said first (4) and second (6) sheets are further vertically coupled along their sewing line (23), provided at a distance from the balumina side which is a function of the kind of sail and/or boat.

5. Sail (2) according to claim 4, wherein only one of said first (4) and second (6) sheets that are vertically coupled to each other along a sewing line (23) continues up to the balumina side.

6. Sail (2) according to claim 1, wherein said transverse ribs (12) are comprised of a first (12*a*) and a second (12*b*) part, said parts being coupled along a median folding line.

7. Sail (2) according to claim 1, wherein said sail further comprises a mast pocket (25), frontally, outside, coupled to said sheets (4, 6), fixing said sail (2) to said mast (8).

8. Sail (2) according to claim 7, wherein said mast pocket (25) is comprised of a single edge, the sail being introduced on the mast from above, or from the bottom.

9. Sail (2) according to claim 7, wherein said mast pocket (25) is comprised of a first (25*a*) and a second (25*b*) edge, coupling in correspondence of the mast by coupling means.

10. Sail (2) according to claim 9, wherein said coupling means comprise a Velcro® strip or a plurality of rings, said rings being coupled by ropes, or a plurality of snap or simple buttons.

11. Sail (2) according to claim 1, characterised in that it provides a plurality of pockets (28) for the slats.

12. Sail (2) according to claim 11, wherein the opening between said pockets (28) for the slats is provided on the mast side.

13. Sail (2) according to claim 11, wherein the opening between said pockets (28) for the slats is provided on the balumina side.

14. Sail (2) according to claim 7, characterised in that said mast pocket (25) is provided with slats pockets (28') on both sides.

15. Sail (2) according to claim 1, characterised in that said first (4) and second (6) sheets and said ribs (12) are comprised of nautical synthetic tissue.

* * * * *